US007224643B2

(12) United States Patent
Morris

(10) Patent No.: US 7,224,643 B2
(45) Date of Patent: May 29, 2007

(54) SELF ADJUSTING VEHICLE CLOCK

(75) Inventor: Steven E. Morris, Fair Haven, MI (US)

(73) Assignee: General Motors Corporation, Detroit, MI (US)

( * ) Notice: Subject to any disclaimer, the term of this patent is extended or adjusted under 35 U.S.C. 154(b) by 218 days.

(21) Appl. No.: 10/881,214

(22) Filed: Jun. 30, 2004

(65) Prior Publication Data

US 2006/0002238 A1 Jan. 5, 2006

(51) Int. Cl.
*G04C 11/02* (2006.01)

(52) U.S. Cl. ..... 368/47

(58) Field of Classification Search ..... 368/47, 368/46, 21, 59, 14, 52; 340/988; 701/1
See application file for complete search history.

(56) References Cited

U.S. PATENT DOCUMENTS

| | | | | |
|---|---|---|---|---|
| 5,724,316 | A * | 3/1998 | Brunts | 368/10 |
| 6,366,834 | B1 | 4/2002 | Hayes et al. | 701/1 |
| 2004/0034455 | A1* | 2/2004 | Simonds et al. | 701/1 |

FOREIGN PATENT DOCUMENTS

AU 9640992 * 5/1996

OTHER PUBLICATIONS

Nokia 1221 User Guide: nds2.nokia.com/files/support/nam/phones/guides/1221_US_en.PDF; Sep. 2004; pp. 24-27.*
Nokia 1221 Home Page: www.nokia.com.br/cda1?id=49598; Dec. 12, 2003.*
nokiahowto.com/1200/howto/f089/steps.html; Feb. 5, 2003.*
nokiahowto.com/1200/1220/index.html.*

* cited by examiner

*Primary Examiner*—Vit Miska
*Assistant Examiner*—Sean Kayes
(74) *Attorney, Agent, or Firm*—Timothy J. Marsh

(57) ABSTRACT

A method and system are provided for adjusting a clock time setting in a vehicle. The system includes a global positioning system that is in communication with a vehicle control module and has a memory that stores geographical data corresponding to time settings for regional time zones. The method includes the steps of determining in which of the regional time zones the vehicle is located, detecting a difference between the vehicle clock time setting and the time setting for the regional time zone in which the vehicle is located, adjusting the vehicle clock time setting if the control module is configured to automatically adjust the vehicle clock time setting, and sending a clock adjustment prompt to a vehicle operator interface if the control module is not configured to automatically adjust the vehicle clock time setting.

19 Claims, 2 Drawing Sheets

SELF ADJUSTING VEHICLE CLOCK

TECHNICAL FIELD

The present invention generally relates to automobiles that are equipped with a clock, and more particularly relates to methods and systems for automatically adjusting the time setting in an automobile clock.

BACKGROUND

Most currently manufactured automobiles include a clock that is positioned inside the automobile cab to be easily seen by the driver. The clock is often a stand alone component. However, other electronic devices such as a radio or other audio/visual devices may have a control panel that displays the time of day.

Although combining a clock display with other displays saves space and may present a well-organized appearance, setting the clock can be complicated or confusing if a plurality of functions are represented in the display. When numerous control knobs, buttons, or switches that are unrelated to the clock functions are combined with clock controls on a single control panel, ordinarily simple tasks such as setting the clock can become less intuitive. An owner's manual is typically provided with an automobile that sets forth the procedure for setting an automobile clock. Yet, it is inefficient to review the owner's manual each time that a clock must be set due to frequent occurrences such as a power source failure, switching to and from daylight savings time, or driving to a different time zone. Further, people may be unaware that some of such occurrences have taken place, and may consequently be unaware that the automobile clock is displaying the wrong time of day.

Accordingly, it is desirable to equip a vehicle with a clock that can be combined with other information displays in an automobile without complicating clock setting procedures. In addition, it is desirable to minimize the need for operators to remember to reset a clock following an occurrence that causes the automobile clock to display the wrong time of day. Furthermore, other desirable features and characteristics of the present invention will become apparent from the subsequent detailed description and the appended claims, taken in conjunction with the accompanying drawings and the foregoing technical field and background.

BRIEF SUMMARY

A method is provided for adjusting a clock time setting in a vehicle using a global positioning system that is in communication with a vehicle control module and has a memory that stores geographical data corresponding to time settings for regional time zones. The method includes the steps of determining in which of the regional time zones the vehicle is located, detecting a difference between the vehicle clock time setting and the time setting for the regional time zone in which the vehicle is located, adjusting the vehicle clock time setting if the control module is configured to automatically adjust the vehicle clock time setting, and sending a clock adjustment prompt to a vehicle operator interface if the control module is not configured to automatically adjust the vehicle clock time setting.

A system is provided for adjusting a clock time setting in a vehicle. The system comprises a memory storing geographical data corresponding to time settings for regional time zones, a communication module in operable communication with the memory, and a vehicle operator communication interface coupled to the communications module. The communication module is configured to detect a difference between the vehicle clock time setting and the time setting for the regional time zone in which the vehicle is located, and transmit a clock adjustment prompt to the vehicle operator communication interface.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Various embodiments of the invention pertain to the use of a GPS to adjust an automobile clock, whether the clock is a stand alone device or integrated with other devices such as a radio. Before adjusting the clock, it is important to alert an automobile operator of the potential clock adjustment and to prompt the operator to input a command to either allow or prevent the clock adjustment. It is also desirable to alert the owner of the potential clock adjustment at a time when it is safe for the operator to respond to the prompt. Coupling a GPS with an automobile clock is an ideal way to safely and efficiently adjust the automobile clock as necessary.

Figure 1:
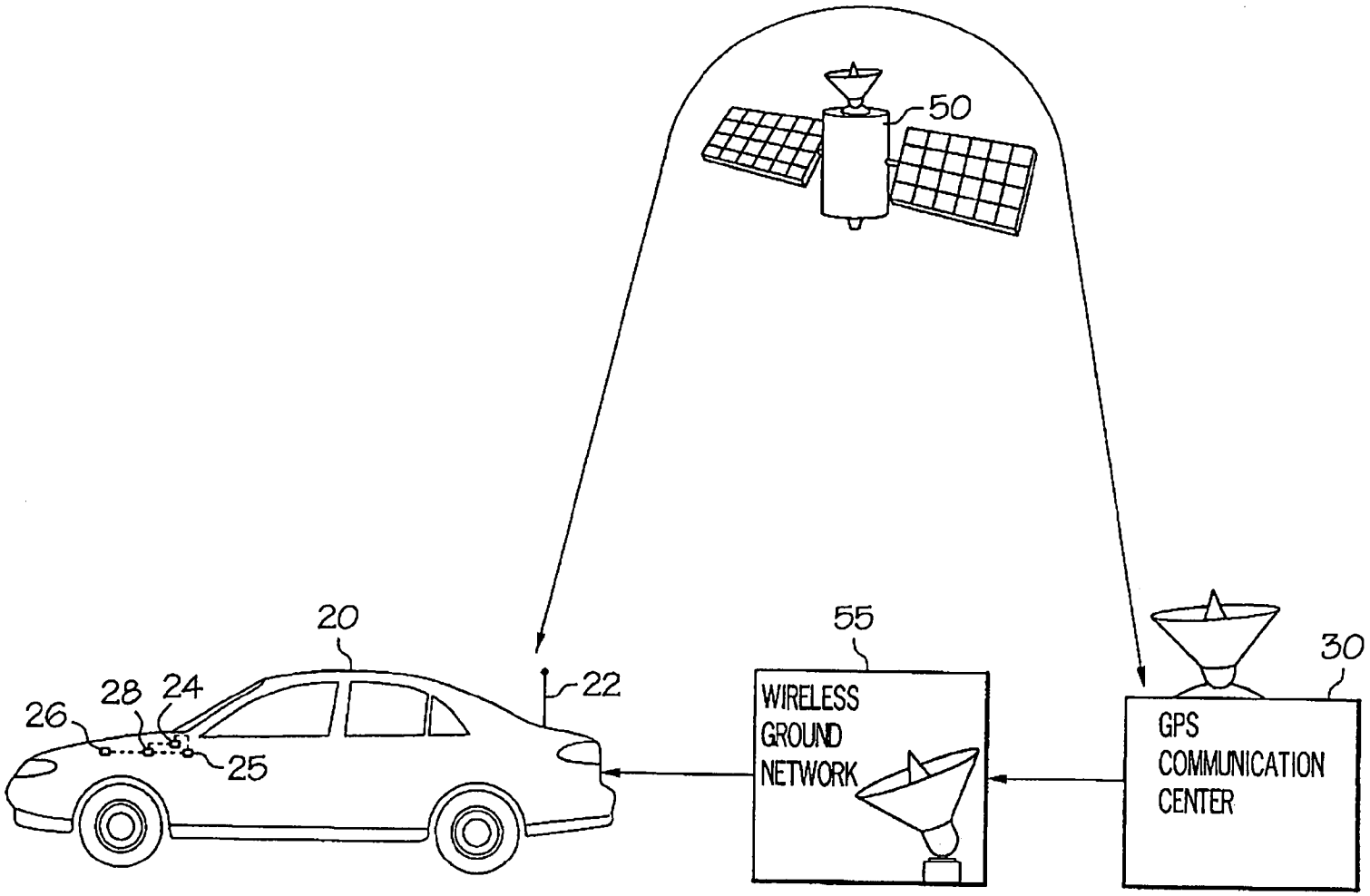
FIG. 1 is a flow diagram illustrating a global positioning system-based clock setting system according to an exemplary embodiment of the invention.

According to an exemplary embodiment of a self-adjusting automobile clock and a clock adjusting system as depicted in FIG. 1, an automobile 20 is equipped with an in-vehicle global positioning system (GPS) transceiver 22. Although FIG. 1 illustrates an automobile 20, it should be understood that the present invention can be used with any type of vehicle, including land, sea, and air vehicles.

The GPS transceiver 22 transmits and receives signals to and from several earth-orbiting satellites arranged in a constellation, collectively identified as satellite 50, to determine automobile position, velocity, and other navigational data. An exemplary system that cooperates with a GPS is a telematics system such as the OnStar® system produced by General Motors Corp. The GPS system includes a master communications module 24 that wirelessly communicates with a GPS system communications center 30 using the satellite 50. An exemplary telematics system that includes a GPS system such as the as OnStar® system also includes a wireless ground network 55 as signal transmission media.

In an exemplary embodiment, the master control module 24 is coupled to at least one vehicle control module 28 in the vehicle computer that is programmed to operate or regulate at least one automobile device unassociated with the in-vehicle communications system. The vehicle control module 28 also regulates adjustment of the automobile clock 25. In another exemplary embodiment, the master communication module 24 is directly coupled to the automobile clock 25, and the master communication module 24 is configured to operate and regulate clock adjustments. The master communication module 24 is also coupled to at least one telephone receiver 26 that converts electrical signals from the satellite 50 or wireless ground network 55 into sounds and transmits those sounds to the automobile occupant by way of a handset or other device incorporating a speaker.

In one embodiment that includes a telematics system that includes a GPS system, the communication center 30 transmits using an analog signal, and an exemplary embodiment operates in the conventional 800 MHz frequency range under a common industry standard known as advanced mobile phone services (AMPS). An analog voice message may be transmitted on a continuous radio wave using frequency modulation similar to an FM radio. An analog data signal is sent using a similar modulation technique known as frequency shift keying. If the digital signal is to be transferred to the vehicle computer, the vehicle control module 28 or other module coupled thereto will be equipped with an analog to digital converter. In a similar but separate embodiment, the communication center 30 transmits using a digital signal, in which a voice message is converted to a digital signal through a vocoder, and a digital data signal does not necessarily need decoding.

The GPS communication system has access to a mean time signal representing, for example, Greenwich England time zone. The GPS communication system also includes a memory that stores data corresponding to regional time zones, and further stores time adjustment factors corresponding to the regional time zones. The memory may be an in-vehicle component that is coupled to the master communication module 24, or the memory may be situated away from the vehicle and wirelessly access the master communication module 24 using the satellite 50 or wireless ground network 55. The earth-orbiting satellite 50 transmits signals that are detected by the automobile GPS transceiver 22. By way of these signals, the automobile position is calculated by methods known to those skilled in the art. The mean time signal is also transmitted by the satellites 50. Upon acquiring both the automobile position and the corresponding regional time zone, the GPS communication system has sufficient data to set the automobile clock by transmitting an adjustment command from the communication center 30 to the vehicle control module 28 and to thereby adjust the clock 25 to a different regional time as the automobile 20 travels between time zones.

For example, if the mean time signal corresponds to Greenwich England time and the automobile is in Greenwich England, no time zone adjustment is necessary. If the automobile is in the Pacific Time zone in the United States of America, the automobile clock is adjusted −8 hours for Pacific Standard Time. If a time changing event takes place such as a switch to daylight savings time, the automobile clock is adjusted from −8 hours to −7 hours for Pacific Daylight Time. Likewise, if the automobile travels to the Mountain Time zone, the automobile clock is adjusted from −8 hours to −7 hours for Mountain Standard Time, and so forth.

Exemplary automobile clock adjustment methods according to the present invention functions are now described with reference to FIG. 2. Such a method may be carried out using the GPS system included in the OnStar® system to make clock adjustments, although it is within the scope of the invention to use any suitable GPS system or other multi-function system that includes a GPS system.

Figure 2:
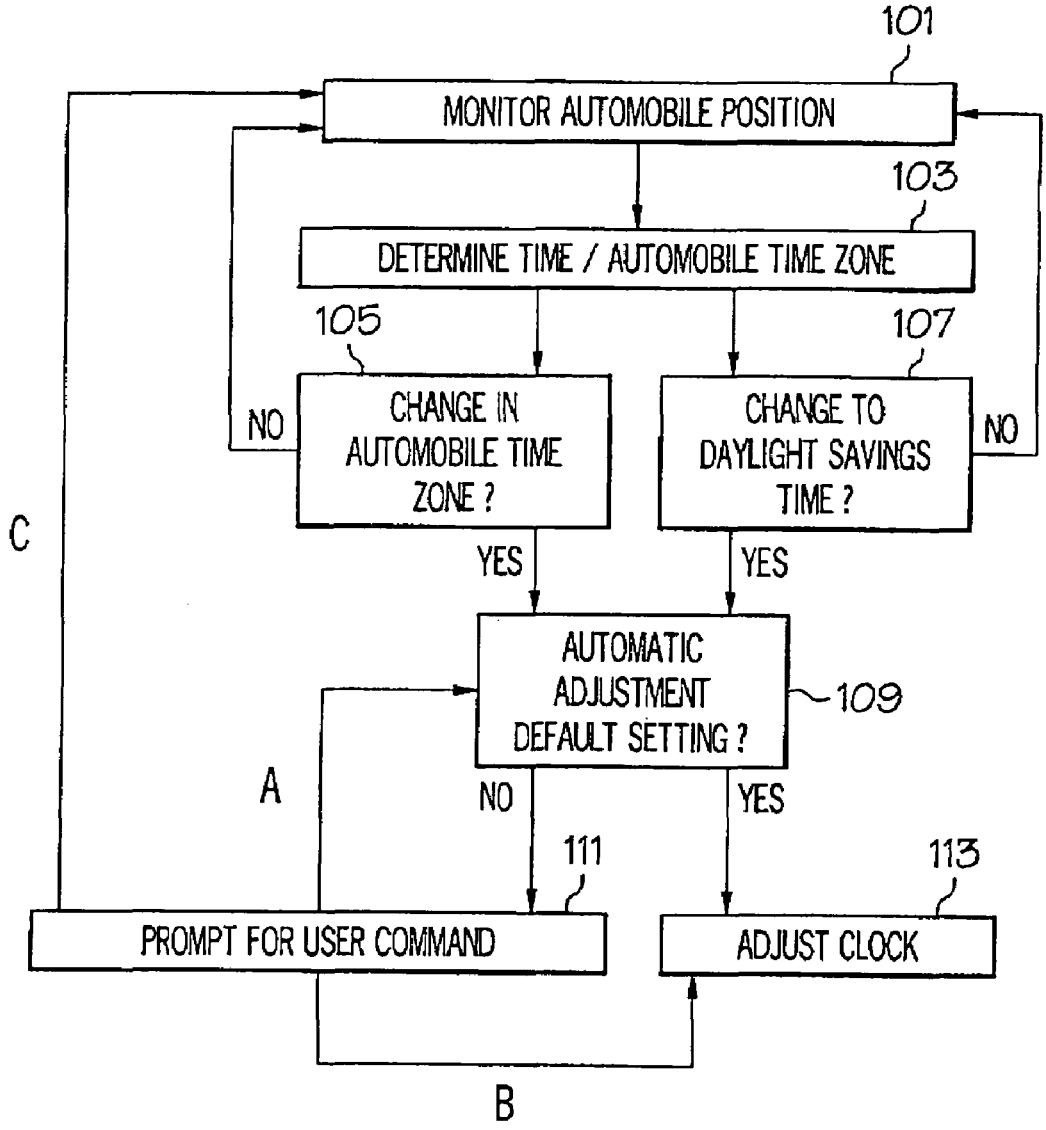
FIG. 2 is a flow diagram of a global positioning system-based clock setting method according to an exemplary embodiment of the invention.

Referring to FIG. 2, the method includes step 101 in which the GPS system monitors the position of an automobile 20 that is equipped with an in-vehicle GPS transceiver. Further, in step 102 the GPS system simultaneously determines the time zone in which the automobile 20 is positioned along with the time of day in that time zone. The time zone and time of day determination step 102 is carried out simultaneous with the automobile positioning step 101, and either or both steps can be carried out continuously, at predetermined intervals, or upon a command from the automobile operator.

While the automobile position is being monitored, the GPS system determines whether a time change may be necessary for the automobile clock 25. The GPS system determines in step 105 whether the automobile has traveled to a different time zone, and also determines in step 107 whether the automobile is in a region that has switched from standard time to daylight savings time or from daylight savings time to standard time. Other occurrences such as a power supply failure may also occur, necessitating a clock adjustment, and determining such events is also within the scope of the invention. If none of these events has occurred, the GPS system continues to carry out step 101 of monitoring the automobile position. However, if either event occurs, the GPS system determines, as step 109, whether the master communication module 24 is configured to automatically make any necessary clock adjustments. In an exemplary embodiment, a GPS system user such as the automobile operator can pre-select or deselect a setting by which the master communication module 24 automatically transmits a clock adjustment signal to the automobile clock 25 or to the vehicle control module 28 when a time changing event occurs, and the setting is preferably a default setting that must be deselected by the GPS user. If the master communication module 24 is configured to automatically transmit clock adjustment signals, the adjustments are made as final step 113, and the method starts over with monitoring step 101.

If the master communication module 24 is not configured to automatically transmit clock adjustment signals, then the master communication module 24 produces a prompt for an operator command. The prompt is sent to a user interface such as a visual display, or to a telephone receiver or other in-vehicle speaker if the prompt is audible. In an exemplary embodiment, the prompt offers a set of operator command options for the operator to choose, and FIG. 2 illustrates three possible options A, B, and C although other operator commands may be offered. Option A reconfigures the system to automatically adjust the clock, and therefore causes the time to be immediately adjusted. Option B causes the clock to be immediately adjusted, but does not reconfigure the system to automatically adjust the clock in the future. Option C causes the clock to maintain the time as displayed prior to the prompt, and the GPS system returns to the monitoring step 101.

In an exemplary embodiment of the invention, the vehicle control module is further configured to detect whether the automobile transmission is in an operative or inoperative setting, particularly if the system is not configured to automatically make clock adjustments. Since it is more likely that the automobile operator can safely respond to a prompt detailing operator command options when the operator is not driving the automobile, the vehicle control module only sends the prompt to the automobile operator if the automobile is set to an inoperative setting. For example, the prompt can be delayed until the automobile is not moving with the brake engaged, or when the automobile transmission is in "park" or otherwise disengaged.

If the master communication module 24 is not configured to automatically transmit clock adjustment signals, the prompt detailing operator command options can displayed on a display associated with the GPS system such as the automobile navigation display. The automobile operator can respond to the prompt and select an option by pressing a button positioned on the radio, positioned on the GPS display, or otherwise associated with a displayed option. In one embodiment of the invention that includes the OnStar® system, the prompt is delivered to the automobile operator by a telephone call that includes a prerecorded message notifying the operator of a change in time. The message is transmitted to a telephone speaker, and the operator can respond to the message by pressing a button or by vocally responding into the telephone microphone. For example, during or after the telephone message transmission the operator can select an option by simply saying which option the operator wishes to be carried out. Thus, the OnStar® system provides automobile operators a safe and hands-free method of responding to a time adjustment prompt.

The various embodiments described above overcome the inconveniences associated with manually setting an automobile clock whenever a time adjustment occurrence takes place. The embodiments include automatic time adjustments following such occurrences, and also include alerting an automobile operator of the potential clock adjustment and permitting the operator to safely respond to the prompt by allowing or preventing the adjustment.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A method of adjusting a clock time setting in a vehicle using a global positioning satellite system including an in-vehicle communication module, a memory in operable communication with the communication module and storing geographical data corresponding to time settings for regional time zones, and a vehicle operator interface that is coupled to the vehicle communication module, the method comprising the steps of:

determining in which of the regional time zones the vehicle is located;

detecting a difference between the vehicle clock time setting and the time setting for the regional time zone in which the vehicle is located;

adjusting the vehicle clock time setting if the communication module is set at an automatic clock adjustment configuration;

determining whether the vehicle is set to an operative or inoperative setting if the communication module is not set at an automatic clock adjustment configuration;

sending a clock adjustment prompt to the vehicle operator interface if the communication module is not set at an automatic clock adjustment configuration and the vehicle is set to an inoperative setting; and delaying the clock adjustment prompt until the vehicle is set to an inoperative setting if the communication module is not set at an automatic clock adjustment configuration.

2. The method according to claim 1, further comprising the step of:

adjusting the vehicle clock in accordance with a user response to the clock adjustment prompt.

3. The method according to claim 1, further comprising the step of:

configuring the communication module to automatically adjust the vehicle clock time setting in accordance with a user response to the clock adjustment prompt.

4. The method according to claim 1, further comprising the step of:

preserving the difference between the vehicle clock time setting and the time setting for the regional time zone in which the vehicle is located in accordance with a user response to the clock adjustment prompt.

5. The method according to claim 1, wherein the step of determining in which of the regional time zones the vehicle is located is performed using the global positioning satellite system.

6. The method according to claim 5, wherein the step of detecting a difference between the vehicle clock time setting and the time setting for the regional time zone in which the vehicle is located comprises:

receiving a signal from a global positioning system communication center, the signal including the time setting for the regional time zone in which the vehicle is located; and comparing the time setting for the regional time zone with the vehicle clock time setting.

7. The method according to claim 1, further comprising the step of detecting a change to or from daylight savings time in the regional time zone in which the vehicle is located.

8. The method according to claim 1, further comprising the step of delaying the clock adjustment prompt until the vehicle is set to an inoperative setting.

9. The method according to claim 8, wherein the vehicle includes a transmission and the clock adjustment prompt is delayed until the transmission is disengaged.

10. A system for adjusting a clock time setting in a vehicle, comprising:

a memory storing geographical data corresponding to time settings for regional time zones;

a communication module in operable communication with the memory, and configured to detect a difference between the vehicle clock time setting and the time setting for the regional time zone in which the vehicle is located, and to transmit a clock adjustment prompt upon such a detection;

a control module configured to receive the clock adjustment prompt and, in response thereto, to:

adjust the vehicle clock time setting if the communication module is set at an automatic clock adjustment configuration, determine whether the vehicle is set to an operative or inoperative setting if the communication module is not set at an automatic clock adjustment configuration, send a clock adjustment prompt to the vehicle operator interface if the communication module is not set at an automatic clock adjustment configuration and the vehicle is set to an inoperative setting, and delay the clock adjustment prompt until the vehicle is set to an inoperative setting if the communication module is not set at an automatic clock adjustment configuration.

11. The system according to claim 10, wherein the communication module is further configured to transmit a clock adjustment signal.

12. The system according to claim 10, wherein the communication module is further configured to adjust the vehicle clock in accordance with a user response to the clock adjustment prompt.

13. The system according to claim 10, wherein the communication module is configured to automatically adjust the vehicle clock time setting in accordance with a user response to the clock adjustment prompt.

14. The system according to claim 10, wherein the communication module is further configured to preserve the difference between the vehicle clock time setting and the time setting for the regional time zone in which the vehicle is located in accordance with a user response to the clock adjustment prompt.

15. The system according to claim 10, wherein the system is a global positioning satellite system.

16. The system according to claim 15, further comprising a global positioning satellite system communication center that transmits a signal to the communication module, the signal including the time setting for the regional time zone in which the vehicle is located, wherein the communication module is further configured to compare the lime setting for the regional time zone with the vehicle clock time setting.

17. The system according to claim 10, wherein the communication module is further configured to detect a change to or from daylight savings time in the regional time zone in which the vehicle is located.

18. The system according to claim 10, wherein the communication module is farther configured to delay the clock adjustment prompt until the vehicle is set to an inoperative setting.

19. The system according to claim 18, wherein the vehicle includes a transmission and the wherein the communication module is further configured to delay the clock adjustment prompt until the transmission is disengaged.

* * * * *